US006990951B1

(12) United States Patent
Liu et al.

(10) Patent No.: US 6,990,951 B1
(45) Date of Patent: Jan. 31, 2006

(54) TORQUE CONTROL STRATEGY FOR A DIESEL ENGINE DURING LEAN-RICH MODULATION USING INDEPENDENT FUEL INJECTION MAPS

(75) Inventors: Zhengbai Liu, Naperville, IL (US); Puning Wei, Naperville, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 0 days.

(21) Appl. No.: 10/889,382

(22) Filed: Jul. 12, 2004

(51) Int. Cl.
*F02D 41/30* (2006.01)

(52) U.S. Cl. ..... 123/299; 123/443; 701/103

(58) Field of Classification Search ..... 123/299, 123/300, 305, 443; 701/103–105
See application file for complete search history.

(56) References Cited

U.S. PATENT DOCUMENTS

| | | | | |
|---|---|---|---|---|
| 5,813,386 | A * | 9/1998 | Okada et al. | 123/339.14 |
| 5,826,427 | A | 10/1998 | Yanagihara et al. | |
| 5,881,693 | A * | 3/1999 | Mizuno | 123/295 |
| 6,012,428 | A | 1/2000 | Yano et al. | |
| 6,491,016 | B1 * | 12/2002 | Buratti | 123/299 |
| 6,543,219 | B1 | 4/2003 | Surnilla | |
| 6,619,033 | B2 | 9/2003 | Adler et al. | |
| 6,857,421 | B2 * | 2/2005 | Adler et al. | 123/681 |
| 6,868,669 | B2 * | 3/2005 | Tanaka | 60/286 |
| 6,931,837 | B2 * | 8/2005 | Verkiel et al. | 60/274 |
| 2003/0110760 | A1 | 6/2003 | Shirakawa | |
| 2003/0150425 | A1 | 8/2003 | Adler et al. | |
| 2005/0022778 | A1 * | 2/2005 | Miura | 123/299 |
| 2005/0102091 | A1 * | 5/2005 | Zhang et al. | 701/104 |

FOREIGN PATENT DOCUMENTS

| | | | |
|---|---|---|---|
| JP | 2002-4912 | * | 1/2002 |
| JP | 2002-4928 | * | 1/2002 |
| JP | 2004-245175 | * | 9/2004 |

OTHER PUBLICATIONS

U.S. Appl. No. 10/703,061, filed Nov. 6, 2003, Verkiel et al.

* cited by examiner

*Primary Examiner*—Hai Huynh
(74) *Attorney, Agent, or Firm*—Dennis Kelly Sullivan; Susan L. Lukasik; Jeffrey P. Calfa

(57) ABSTRACT

A compression ignition engine (10) for a motor vehicle has a control system (20) for processing data, one or more combustion chambers (12), and fuel injectors (18) for injecting fuel into the chambers. The control system controls lean-rich modulation of fueling using independent maps. One set of maps is a set of lean fueling maps, and another set is a set of rich fueling maps. The strategy is represented by a flow diagram (30) and is useful in regenerating a $NO_x$ adsorber catalyst (16) in the engine exhaust system (14) in a manner that controls torque so that the regeneration process is transparent to the operator of the vehicle.

20 Claims, 3 Drawing Sheets

(LEAN FUEL INJECTION MAP)

(RICH FUEL INJECTION MAP)

TORQUE CONTROL STRATEGY FOR A DIESEL ENGINE DURING LEAN-RICH MODULATION USING INDEPENDENT FUEL INJECTION MAPS

FIELD OF THE INVENTION

This invention relates generally to internal combustion engines. More specifically it relates to a strategy for controlling engine torque during lean-rich modulation of engine fueling.

BACKGROUND OF THE INVENTION

An exhaust system of a diesel engine that comprises a $NO_x$ adsorber catalyst is capable of adsorbing substantial amounts of oxides of nitrogen ($NO_x$) in engine exhaust gases passing through the exhaust system from the engine. The $NO_x$ adsorber catalyst thereby reduces the amount of $NO_x$ entering the atmosphere, preventing the trapped $NO_x$ from contributing to what might otherwise become smog.

Use of a $NO_x$ adsorber catalyst has the potential for enabling future diesel engines to meet the requirements of increasingly stringent tailpipe emission regulations promulgated by the United States Environmental Protection Agency.

When a $NO_x$ adsorber catalyst is present in the exhaust system of a motor vehicle powered by a diesel engine, it is desirable to regenerate the $NO_x$ adsorber catalyst from time to time to remove trapped $NO_x$ so that the catalyst can continue to be effective. Regeneration is typically performed only when prevailing conditions are suitable. When a certain level of adsorbed $NO_x$ is reached, regeneration is forced. The products of regeneration are non-pollutants that are naturally present in the atmosphere.

A $NO_x$ adsorber catalyst uses high levels of CO to accomplish its regeneration. Those high levels can be realized by post-injection of fuel, meaning one or more injections that occur after a main fueling injection into a cylinder during an engine cycle.

Thus, a diesel engine that has $NO_x$ adsorber catalyst in its exhaust system runs in either of what may be considered two types of conditions: 1) lean operating condition where the engine is fueled in the usual manner; and 2) rich operating condition where the engine is fueled with post-injection in order to regenerate the $NO_x$ adsorber catalyst. It is during regeneration that rich modulation occurs.

During regeneration it is desirable that the engine torque be kept substantially the same as would be in the absence of regeneration so that an operator of the vehicle will not notice the regeneration. Also, the rich modulation that occurs during regeneration should not create undesired torque fluctuations.

It should be apparent however that the addition of a post-injection of fuel in order to richen the air-fuel mixture being combusted during the engine cycle will cause engine torque to increase.

In order to make regeneration transparent to the vehicle operator insofar as the effect of post-injection on engine torque is concerned, the amount of fuel injected during an engine cycle into a cylinder prior to the added post-injection needs to be reduced.

SUMMARY OF THE INVENTION

The present invention relates to an engine, system, and method for a torque control strategy during lean-rich modulation of fueling in a diesel engine. In particular, the invention employs two independent sets of fuel injection maps, one for lean operation, the other for rich operation.

The invention is embodied in the fuel injection control strategy, a strategy that is programmed in an associated processing system.

One generic aspect of the present invention relates to a method of operating a compression ignition engine to accomplish lean-rich modulation of fueling. The method comprises processing certain data to modulate fueling between lean modulation and rich modulation. During lean modulation, data representing a particular set of operating conditions is processed to select a particular lean fueling map that comprises fueling data appropriate to the particular set of operating conditions for causing the engine to be fueled in a manner that causes the engine to run lean and develop a corresponding torque. During rich modulation, data representing substantially the same particular set of operating conditions is processed to select a particular rich fueling map that comprises fueling data appropriate to that substantially same particular set of operating conditions for causing the engine to be fueled in a manner that causes the engine to run rich and develop substantially the same corresponding torque as during lean modulation.

A further aspect of the method concerns the application of the steps just described to the regeneration of a $NO_x$ adsorber catalyst in the exhaust system of the engine.

A further generic aspect relates to a compression ignition engine having a control system for processing data including a set of lean fueling maps and a set of rich fueling maps, one or more combustion chambers, and a fueling system for injecting fuel into the one or more combustion chambers. At times the control system modulates fueling between lean modulation and rich modulation.

For lean modulation, the control system processes data representing a particular set of operating conditions to select a particular lean fueling map that comprises fueling data appropriate to the particular set of operating conditions for causing the engine to be fueled in a manner that causes the engine to run lean and develop a corresponding torque.

For rich modulation, the control system processes data representing substantially the same particular set of operating conditions to select a particular rich fueling map that comprises fueling data appropriate to that substantially same particular set of operating conditions for causing the engine to be fueled in a manner that causes the engine to run rich and develop substantially the same corresponding torque as during lean modulation.

A further aspect relates to an engine as just described having a $NO_x$ adsorber catalyst in its exhaust system that is regenerated by rich modulation.

The foregoing, along with further features and advantages of the invention, will be seen in the following disclosure of a presently preferred embodiment of the invention depicting the best mode contemplated at this time for carrying out the invention. This specification includes drawings, now briefly described as follows.

DESCRIPTION OF THE PREFERRED EMBODIMENT

Figure 1:
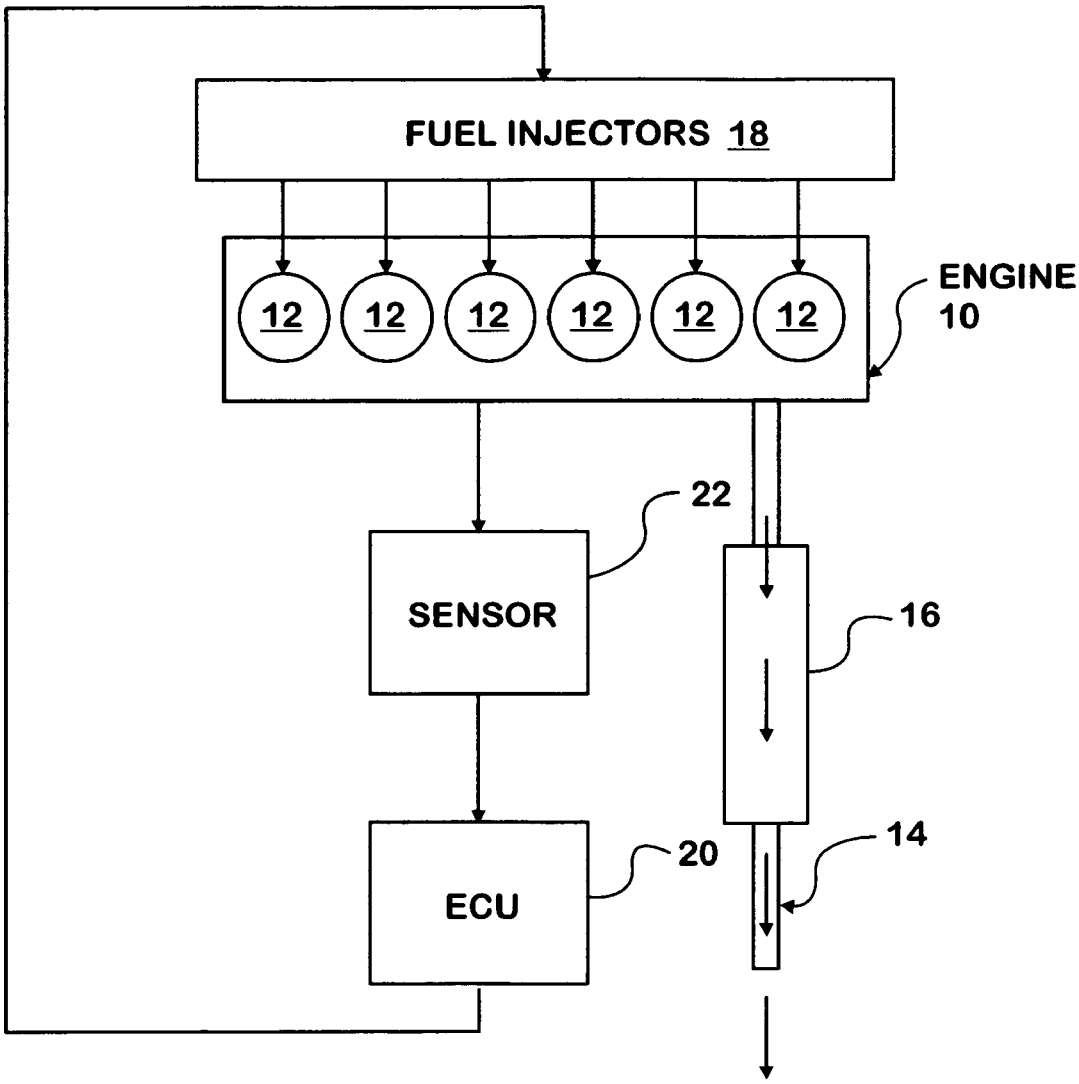
FIG. 1 is a general schematic diagram of portions of an exemplary diesel engine relevant to certain principles of the present invention.

FIG. 1 shows a portion of a representative diesel engine 10 that operates in accordance with principles of the present invention. Engine 10 is used for powering a motor vehicle and comprises cylinders 12 (six in this example) within which pistons reciprocate. Each piston is coupled to a respective throw of a crankshaft by a corresponding connecting rod. Intake air is delivered to each cylinder through an intake system (not specifically shown in the drawing) when a respective intake valve is open. Exhaust resulting from in-cylinder combustion leaves each cylinder 12 to enter an exhaust system 14 when a respective exhaust valve is open. Exhaust system 14 includes a $NO_x$ adsorber catalyst 16 that is capable of adsorbing substantial amounts of oxides of nitrogen ($NO_x$) in engine exhaust gases passing through exhaust system 14 from engine cylinders 12.

Engine 10 further comprises a fueling system that comprises fuel injectors 18 for cylinders 12. The engine also has a processor-based engine control unit (ECU) 20 that processes data from various sources to develop various control data for controlling various aspects of engine operation. The data processed by ECU 20 may originate at external sources, such as various sensors 22, and/or be generated internally. Examples of data processed may include engine speed, intake manifold pressure, exhaust manifold pressure, fuel injection pressure, fueling quantity and timing, mass airflow, and accelerator pedal position. Data representing the amount of $NO_x$ adsorbed in $NO_x$ adsorber catalyst 16 is also data that is processed by ECU 20 in practice of the invention.

ECU 20 controls the injection of fuel into cylinders 12 by controlling the operation of the fueling system, including controlling the operation of fuel injectors 18. The processing system embodied in ECU 20 can process data sufficiently fast to calculate, in real time, the timing and duration of device actuation to set both the timing and the amount of each injection of fuel into a cylinder. Such control capability is used to implement the inventive strategy.

The processing system of ECU 20 comprises the two types of fuel injection maps established for the particular diesel engine model. Based on the result of the processing of various data by ECU 20, one type of map or the other is selected for use to control fuel injection during lean-rich modulation.

The first type of map is for lean fueling, and the second type is for rich fueling. Lean-rich modulation is performed by switching back and forth between the two types of maps.

Figure 3A:
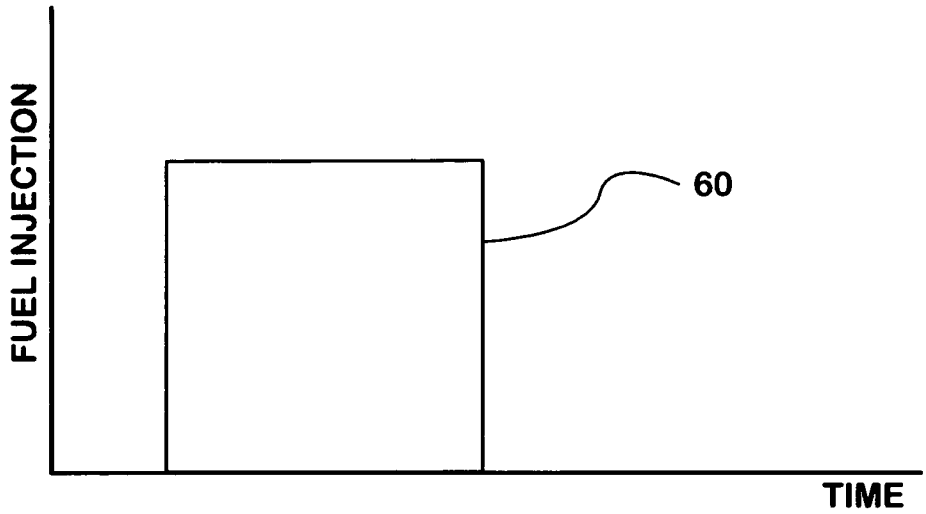
FIG. 3A is a representative graphic portrayal of fueling strategy for lean fueling in accordance with principles of the present invention.
Figure 3B:
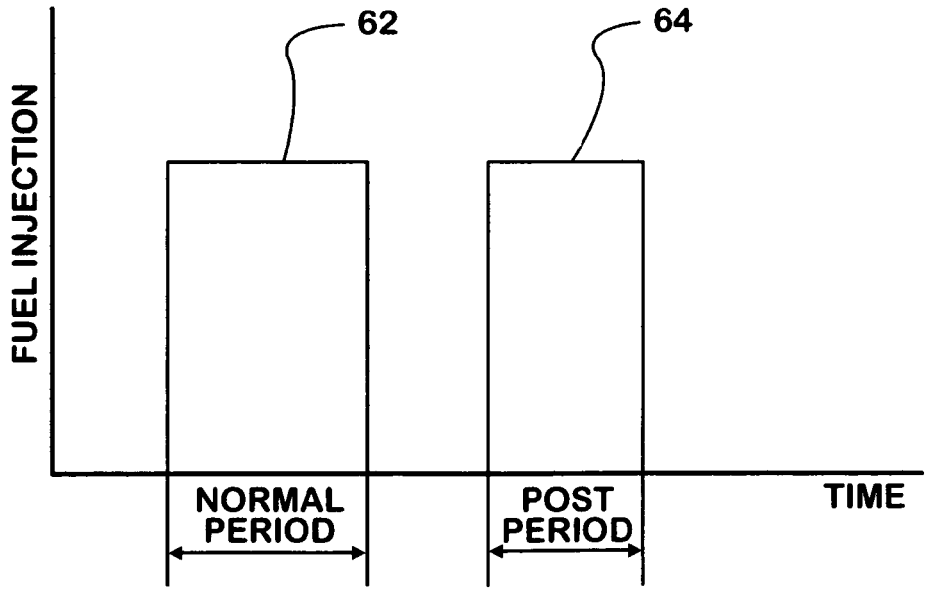
FIG. 3B is a representative graphic portrayal of fueling strategy for rich fueling in accordance with principles of the present invention.

In general rich fueling causes a post-injection of fuel after a main injection during an engine cycle while lean fueling does not. FIG. 3A is a generic representation of lean fueling consisting of a single main injection 60 while FIG. 3B is a generic representation of rich fueling consisting of a single main injection 62 followed by a post-injection 64. Although not specifically shown, pilot injection could occur for either type of fueling prior to the main injection.

When engine 10 is modulated lean, a lean fueling map is used to control fueling. When engine 10 is modulated rich, a rich fueling map is used to control fueling.

The particular characteristics of a lean fueling map are developed by operating engine 10 to get optimized performance and emissions results for particular sets of operating conditions. Because operating conditions change, ECU 20 contains a number of lean fueling maps, each correlated with a particular set of operating conditions. In that way, as operating conditions change, optimum fueling is obtained.

Likewise, the particular characteristics of a rich fueling map are developed by operating engine 10 to get optimized performance and emissions results for particular sets of operating conditions. ECU 20 contains a number of rich fueling maps, each correlated with a particular set of operating conditions so that as operating conditions change while the engine is modulated rich, optimum fueling continues to be obtained.

When engine 10 is modulated rich, the addition of post-injection will tend to increase engine torque. The increased torque is a function of factors like engine speed, post-injection timing, post-injection quantity, and engine load. For a particular engine speed and a particular engine load, particular characteristics of post-injection fueling are chosen to cause the engine to generate a proper amount of carbon monoxide (CO) for regeneration. In this way, post-injection fueling optimizes the regeneration process, but with some increase in torque.

In order to make the lean-rich modulation needed for regeneration transparent to the vehicle operator insofar as it affects engine torque, the torque increase caused by post-injection fueling is counterbalanced by change in fueling that occurs prior to post-injection in the engine cycle. Accordingly, the characteristics of a main injection 62 are changed in an appropriate manner in relation to the characteristics of the following post-injection 64 to minimize, and ideally reduce to zero, the difference between torque generated during rich modulation for a particular set of operating conditions and torque generated during lean modulation for the same set of operating conditions.

Figure 2:
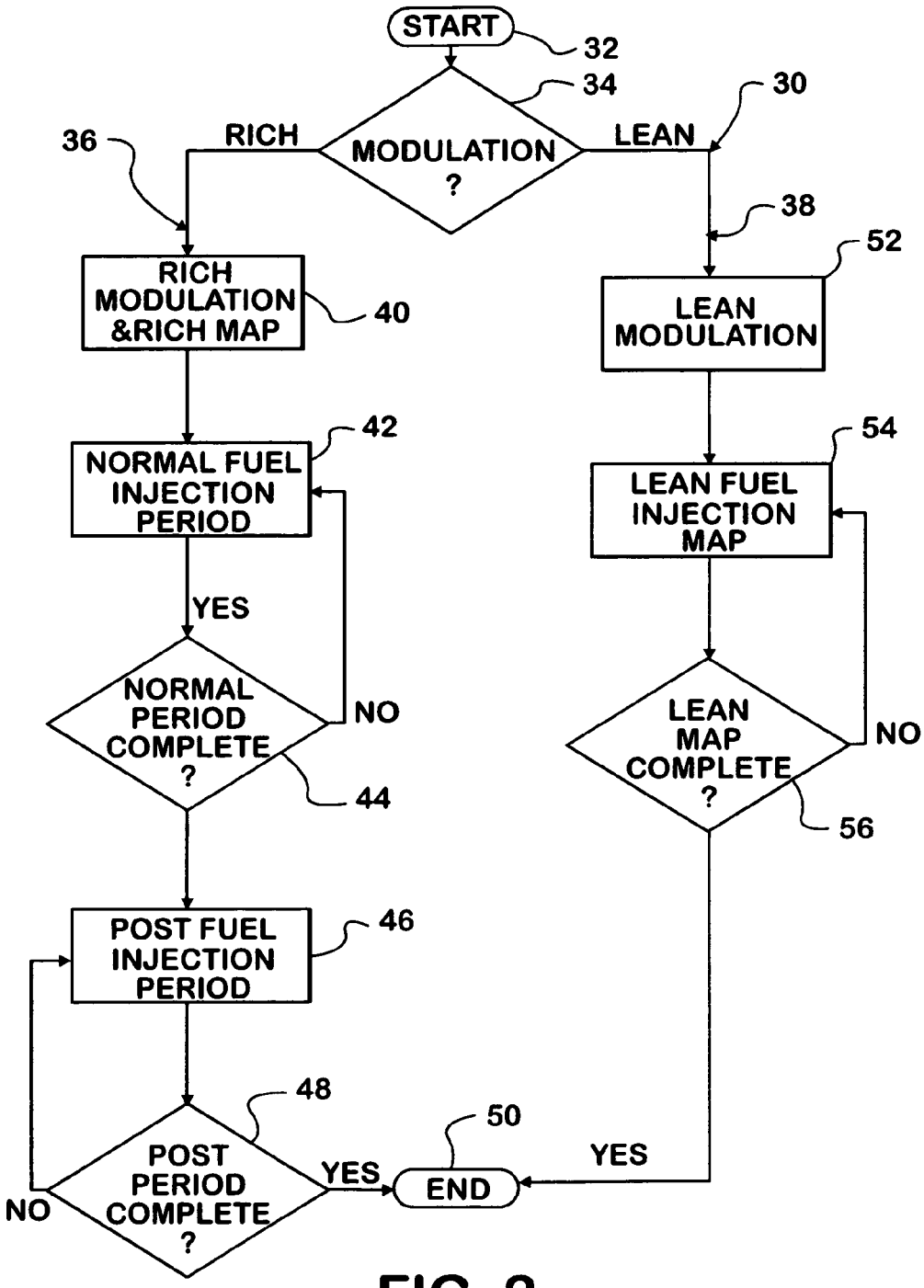
FIG. 2 is a flow diagram illustrating an embodiment of the inventive torque control strategy utilized in the engine of FIG. 1.

FIG. 2 shows a flow diagram 30 for the inventive strategy as executed by the processing system of ECU 20. The reference numeral 32 represents the start of the strategy. A step 34 processes certain data to determine which of the two types of fueling is to be selected.

When step 34 selects rich fueling, flow diagram 30 proceeds along a series of steps 36. When step 34 selects lean fueling, flow diagram 30 proceeds along a series of steps 38.

Steps 36 commence with a step 40 that selects a particular rich fueling map based on a particular set of operating conditions. The map provides a particular fuel injection profile that during an engine cycle will provide post-injection fueling consistent with the generic example 64 and pre-post-injection fueling consistent with the generic example 62 that may comprise a single main injection with the optional possibility of one or more pilot injections. Pre-post-injection fueling is represented by the steps 42 and 44 in FIG. 2, and post-injection fueling by the steps 46 and 48. After step 48, the current execution of the strategy ends at step 50, only to re-iterate at step 32.

Steps 38 commence with a step 52 that selects a particular lean fueling map based on a particular set of operating conditions. The map provides a particular fuel injection profile that during an engine cycle will provide fueling consistent with the generic example 60 that may comprise a single main injection with the optional possibility of one or more pilot injections. The steps 54 and 56 represent the actual injection. After step 56, the current execution of the strategy ends at step 50, only to re-iterate at step 32.

Although the generic characteristics 60, 62, 64 in FIGS. 3A and 3B show the fueling pulses of constant height but different widths, it is to be appreciated that such showing should not necessarily be interpreted to imply that fueling rate remains constant and only the duration of an injection changes. Particular fueling characteristics may change in any suitable way to accomplish the desired lean-rich modulation for regeneration while minimizing torque change due to the modulation. Hence, one or more of fueling rate, pulse width, and pulse timing may change, as well as the inclusion or omission of pilot injection.

In a summary, the present invention has the following unique features and advantages:

The present invention can realize the lean-rich modulation in a diesel engine by using two sets of independent fuel injection maps stored in the engine control unit (ECU), one set comprising multiple maps each providing lean fueling for a particular set of operating conditions, the other set comprising multiple maps each providing rich fueling for a particular set of operating conditions.

The present invention can provide enough CO to regenerate the $NO_x$ adsorber catalyst at rich modulation.

The present invention can keep the diesel engine torque substantially constant during lean-rich modulation.

The present invention can minimize fuel consumption.

The present invention can make a diesel engine work at optimized conditions for both lean modulation and rich modulation.

The present invention can be used for heavy-duty and medium-duty, as well as lightly-duty diesel engines.

The lean fuel injection maps are established by operating a given diesel engine at its lean modulation for different sets of operating conditions.

The rich fuel injection maps include two fuel injection periods, that is, the normal period and the post period, respectively. Each rich map is established by operating the given diesel engine at its rich modulation for different sets of operating conditions.

A lean fuel injection map has at least one fuel injection, but may have multiple fuel injections (main+pilot).

The pre-post-injection period of a rich fuel injection map has at least one fuel injection, but may have multiple fuel injections (main+pilot).

While a presently preferred embodiment of the invention has been illustrated and described, it should be appreciated that principles of the invention apply to all embodiments falling within the scope of the following claims.

What is claimed is:

1. A method of operating a compression ignition engine to accomplish lean-rich modulation of fueling, the method comprising:

processing certain data to modulate fueling between lean modulation and rich modulation;

during lean modulation, processing data representing a particular set of operating conditions to select a particular lean fueling map that comprises fueling data appropriate to the particular set of operating conditions for causing the engine to be fueled in a manner that causes the engine to run lean and develop a corresponding torque; and during rich modulation, processing data representing substantially the same particular set of operating conditions to select a particular rich fueling map that comprises fueling data appropriate to that substantially same particular set of operating conditions for causing the engine to be fueled in a manner that causes the engine to run rich and develop substantially the same corresponding torque as during lean modulation.

2. A method as set forth in claim 1 wherein during lean modulation, the particular lean fueling map selected causes the engine to be fueled by a main fuel injection without post-injection.

3. A method as set forth in claim 1 wherein during lean modulation, the particular lean fueling map selected causes the engine to be fueled by a one or more pilot injections followed by a main fuel injection without post-injection.

4. A method as set forth in claim 1 wherein during rich modulation, the particular rich fueling map selected causes the engine to be fueled by a main fuel injection with post-injection.

5. A method as set forth in claim 1 wherein during rich modulation, the particular rich fueling map selected causes the engine to be fueled by a one or more pilot injections followed by a main fuel injection with post-injection.

6. A compression ignition engine comprising:

a control system for processing data including a set of lean fueling maps and a set of rich fueling maps;

one or more combustion chambers; and a fueling system for injecting fuel into the one or more combustion chambers;

wherein the control system at times modulates fueling between lean modulation and rich modulation, and for lean modulation, processes data representing a particular set of operating conditions to select a particular lean fueling map that comprises fueling data appropriate to the particular set of operating conditions for causing the engine to be fueled in a manner that causes the engine to run lean and develop a corresponding torque; and for rich modulation, processes data representing substantially the same particular set of operating conditions to select a particular rich fueling map that comprises fueling data appropriate to that substantially same particular set of operating conditions for causing the engine to be fueled in a manner that causes the engine to run rich and develop substantially the same corresponding torque as during lean modulation.

7. An engine as set forth in claim 6 wherein for lean modulation, the control system selects a particular lean fueling map that causes the engine to be fueled by a main fuel injection without post-injection.

8. An engine as set forth in claim 6 wherein for lean modulation, the control system selects a particular lean fueling map that causes the engine to be fueled by one or more pilot injections followed by a main fuel injection without post-injection.

9. An engine as set forth in claim 6 wherein for rich modulation, the control system selects a particular rich fueling map that causes the engine to be fueled by a main fuel injection with post-injection.

10. An engine as set forth in claim 6 wherein for rich modulation, the control system selects a particular rich fueling map that causes the engine to be fueled by one or more pilot injections followed by a main fuel injection with post-injection.

11. A method of operating a compression ignition engine to accomplish lean-rich modulation of fueling for regeneration of a $NO_x$ adsorber catalyst in an exhaust system of the engine, the method comprising:

processing certain data to modulate fueling between lean modulation and rich modulation;

during lean modulation, processing data representing a particular set of operating conditions to select a particular lean fueling map that comprises fueling data appropriate to the particular set of operating conditions for causing the engine to be fueled in a manner that causes the engine to run lean and develop a corresponding torque; and during rich modulation, processing data representing substantially the same particular set of operating conditions to select a particular rich fueling map that comprises fueling data appropriate to that substantially same particular set of operating conditions for causing the engine to be fueled in a manner that causes the engine to run sufficiently rich to create sufficient carbon monoxide for regenerating the $NO_x$ adsorber catalyst while developing substantially the same corresponding torque as during lean modulation.

12. A method as set forth in claim 11 wherein during lean modulation, the particular lean fueling map selected causes the engine to be fueled by a main fuel injection without post-injection.

13. A method as set forth in claim 11 wherein during lean modulation, the particular lean fueling map selected causes the engine to be fueled by a one or more pilot injections followed by a main fuel injection without post-injection.

14. A method as set forth in claim 11 wherein during rich modulation, the particular rich fueling map selected causes the engine to be fueled by a main fuel injection with post-injection.

15. A method as set forth in claim 11 wherein during rich modulation, the particular rich fueling map selected causes the engine to be fueled by a one or more pilot injections followed by a main fuel injection with post-injection.

16. A compression ignition engine comprising:

a control system for processing data including a set of lean fueling maps and a set of rich fueling maps;

one or more combustion chambers;

a fueling system for injecting fuel into the one or more combustion chambers; and an exhaust system having a $NO_x$ adsorber catalyst through which exhaust from the combustion chambers is constrained to pass;

wherein the control system at times modulates fueling between lean modulation and rich modulation for regenerating the $NO_x$ adsorber catalyst, and for lean modulation, processes data representing a particular set of operating conditions to select a particular lean fueling map that comprises fueling data appropriate to the particular set of operating conditions for causing the engine to be fueled in a manner that causes the engine to run lean and develop a corresponding torque; and for rich modulation, processes data representing substantially the same particular set of operating conditions to select a particular rich fueling map that comprises fueling data appropriate to that substantially same particular set of operating conditions for causing the engine to be fueled in a manner that causes the engine to run sufficiently rich to create sufficient carbon monoxide for regenerating the $NO_x$ adsorber catalyst while developing substantially the same corresponding torque as during lean modulation.

17. An engine as set forth in claim 16 wherein for lean modulation, the control system selects a particular lean fueling map that causes the engine to be fueled by a main fuel injection without post-injection.

18. An engine as set forth in claim 16 wherein for lean modulation, the control system selects a particular lean fueling map that causes the engine to be fueled by one or more pilot injections followed by a main fuel injection without post-injection.

19. An engine as set forth in claim 16 wherein for rich modulation, the control system selects a particular rich fueling map that causes the engine to be fueled by a main fuel injection with post-injection.

20. An engine as set forth in claim 16 wherein for rich modulation, the control system selects a particular rich fueling map that causes the engine to be fueled by one or more pilot injections followed by a main fuel injection with post-injection.

* * * * *